United States Patent [19]

Günther et al.

[11] Patent Number: 4,578,547

[45] Date of Patent: Mar. 25, 1986

[54] ELECTRIC SWITCH

[75] Inventors: Horst H. Günther, Ansbach; Hermann F. Oesterle, Lauf, both of Fed. Rep. of Germany

[73] Assignee: International Standard Electric Corporation, New York, N.Y.

[21] Appl. No.: 656,700

[22] Filed: Oct. 1, 1984

[30] Foreign Application Priority Data

Oct. 5, 1983 [DE] Fed. Rep. of Germany ..... 3336130

[51] Int. Cl.[4] ..... H01H 19/54; H01H 9/00

[52] U.S. Cl. ..... 200/11 DA; 200/292

[58] Field of Search ..... 200/11 DA, 11 TW, 292, 200/11 G

[56] References Cited

U.S. PATENT DOCUMENTS

| | | | |
|---|---|---|---|
| 2,896,033 | 7/1959 | Hartz | 200/11 DA |
| 3,794,784 | 2/1974 | Snider | 200/11 DA |
| 3,828,285 | 8/1974 | Yokoyama et al. | 200/11 DA X |
| 4,038,504 | 7/1977 | McAnulty et al. | 200/11 DA |
| 4,135,065 | 1/1979 | Nicot | 200/11 DA |
| 4,246,453 | 1/1981 | Marchese et al. | 200/11 DA X |
| 4,390,757 | 6/1983 | Wiessner | 200/292 X |

FOREIGN PATENT DOCUMENTS

| | | | |
|---|---|---|---|
| 2441469 | 3/1976 | Fed. Rep. of Germany | 200/11 DA |

*Primary Examiner*—J. R. Scott

*Attorney, Agent, or Firm*—James B. Raden; William J. Michals

[57] ABSTRACT

Electric switches whose fixed contacts (3) are formed by the conductors on a printed circuit board (1), which are coated with a layer of noble metal, the connections between the fixed contacts provided on a contact path (2) and electrically connected among each other, extend outside the contact paths (2) of the movable contacts. Prior to the application of the layer of noble metal the connecting lines are covered and, therefore, a considerable saving of noble metal results.

5 Claims, 3 Drawing Figures

Fig. 2
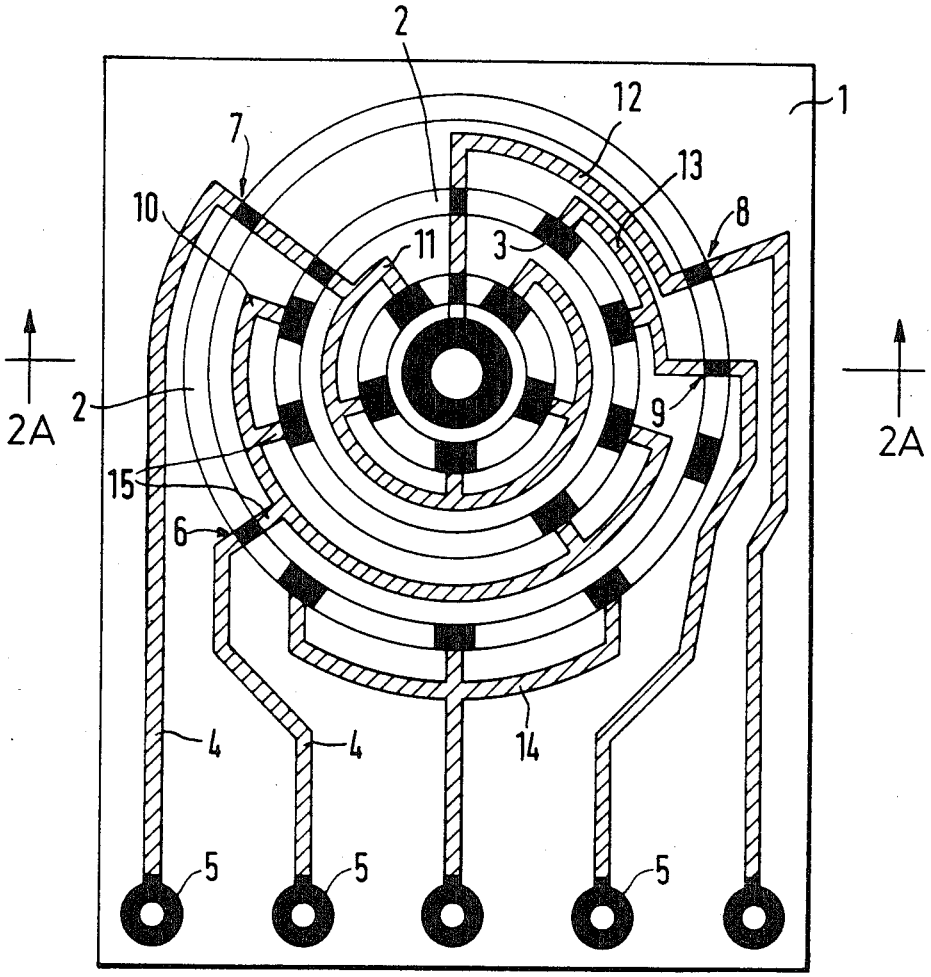
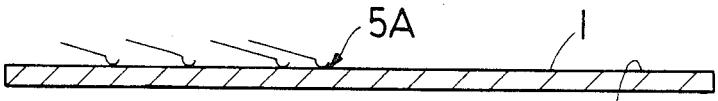
Fig. 2A

ELECTRIC SWITCH

BACKGROUND OF THE INVENTION

The present invention relates to an electric switch whose fixed contacts incude printed conductors on a printed circuit board which are coated with a layer of noble metal, and whose moving contacts are designed as sliding contacts capable of moving along predetermined contact paths over the fixed contacts on the printed circuit board, and in which on one contact path there are provided several fixed contacts which are electrically connected to each other.

Various types of electric switches are known in the art in which the fixed contacts are formed by parts of printed conductors disposed on a printed circuit board. The moving contacts of such switches are designed as sliding contacts, either as contact springs or as contact members which, with the aid of springs separated therefrom are pressed on to the contacts on the printed conductor. The sliding contacts are guided along predtermined paths over the fixed contacts on the printed circuit board, that is, in the case of rotary switches along circular paths and, in the case of sliding switches, on straight paths.

As the material for the printed conductors there is mostly used a layer of copper laminated on to the printed circuit board and from which the printed conductors, preferably by employing a photoetching process, are etched out. The printed copper conductors, however, are unsuitable for use as contacts in a switch, because the copper easily oxidizes thus increasing the transfer resistance between the moving and the fixed contacts to an inadmissible extent.

Therefore, such fixed contacts which are formed by printed conductors, are coated as a rule, with a layer of noble metal, such as with a layer of gold. This gold plating is mostly deposited in the course of a galvanic process. In the course of this, all printed conductors of the printed circuit board are coated with a layer of gold.

Although the gold plating has a very small thickness, less than millimeter, the gold layer which is indispensable for the stationary contacts, runs up to a considerable portion of the price for the entire printed circuit board.

One has therefore proceeded to provide only those parts of the printed conductors of the printed circuit board with a gold plating which actually serve the contact making. This is done in such a way that a pattern of lacquer is printed on, which only covers up those parts of the printed conductors which are not supposed to be provided with a gold plating. In this way it is possible to save a considerable amount of the costs for the layer of gold.

After the gold-plating of the free sections of the printed conductors, the covering lacquer remains on the printed circuit board, because a removal would involve additional processing steps and costs, and because it simultaneously also serves as a corrosion protection for those part of the printed conductos which are not coated with a layer of noble metal.

The covering lacquer for the gold plating, however, may in no case be applied to those parts of the printed circuit boards which correspond to the contact paths of the moving contacts. Owing the wear during actuation of the switch, the material of the layer of lacquer would get on to both the moving an the fixed contacts and would thus result in considerable contact disturbances.

It has therefore been accepted that within the area of the contact paths of the moving contacts a covering of the printed conductors prior to the gold plating is impossible.

In these prior art switches, several fixed contacts disposed on one contact path are electrically connected to each other. One example of such switches are the so-called code switches. Up to now, such fixed contacts which are electrically connected to one another and disposed on one common contact path, have been designed as one single continuous contact which, of course, has to be provided throughtout its entire length with a coating of noble metal, such as a layer of gold.

It is the object of the invention to achieve a further saving of noble metal in the case of switches of the aforementioned type.

SUMMARY OF THE INVENTION

A considerable amount of noble metal can be saved by disposing the printed conductors serving the connection of the individual fixed contacts, outside the contact paths of the moving contacts. In so doing, it becomes possible to cover these connections prior to the gold plating, with a covering lacquer so that only the actual contacts are subjected to the gold plating. This enables a further considrable reduction in the required amount of noble metal for such switches and, consequently, also the overall costs for such switches.

Since the printed conductors of the switches in question, are obtained by etching out a copper layer originally covering the entire printed circuit board, the connecting lines and lead-in conductors for the fixed contacts can be disposed in any optional way on the printed circuit board, and may also have any optional shape and length without thus changing the material consumption or the manufacturing investment. In the case of longer printed conductors even the etching paths are used up less quickly, because less copper has to be dissolved. By the invention, therefore, it is possible without any additional investment processing steps or material, to achieve a considerable saving of noble metal when manufacturing switches of the aforementioned type.

The connecting lines for the contacts disposed on a contact path, could extend directly along the rim of the contact path. This, however, would require the covering lacquer for the noble-metal coating to be printed very precisely. This would also involve a very high investment in the lacquer printing. In order to avoid such an investment and in order yet to make sure that the contacts are coated reliably and completely, the covering lacquer is disposed at a small spacing from the contact path. This implies, however, that the coating of noble metal still extends somewhat beyond the contact path. If now the connecting lines were to extend to directly follow the contact path, a narrow rim portion thereof would also be covered with the noble metal.

According to a further embodiment of the invention, therefore, the connecting lines are disposed at a distance from the contact paths and are connected to the contacts via connecting webs. In that case merely narrow strips of the connecting webs, following the contacts, are still coated with the layer of noble metal.

It is of particular advantage for the printed conductors serving the connection of the fixed contacts on a contact path, to extend almost parallel in relation to the contact path, and for the connecting webs to extend almost vertically in relation to the contact path.

A further saving of noble metal can be achieved in that the lead-in conductors extending to the fixed contacts are disposed in such a way that in the case of the then unavoidable intersections of contact paths, the lead-in conductors are disposed as rectangularly or radially as possible in relation to the contact path. Since, as already mentioned hereinbefore, it is impossible to apply the covering lacquer to the contact path, it is unavoidable for the printed conductors forming the lead-in conductors, to be gold-plated as well at the intersecting points with the contact paths. From a rectangular intersection, however, there will result the smallest surface area to be gold plated.

BRIEF DESCRIPTION OF THE DRAWINGS

The invention will now be explained in greater detail with reference to FIGS. 1 and 2 of the accompanying drawing, in which:

FIG. 2 shows the same printed circuit board as in FIG. 1, but with a printed conductor pattern according to the invention;

FIG. 2A is a partially cross-sectional and schematic view of the board taken substantially along the lines 2A—2A in FIG. 2.

DETAILED DESCRIPTION

Figure 1:
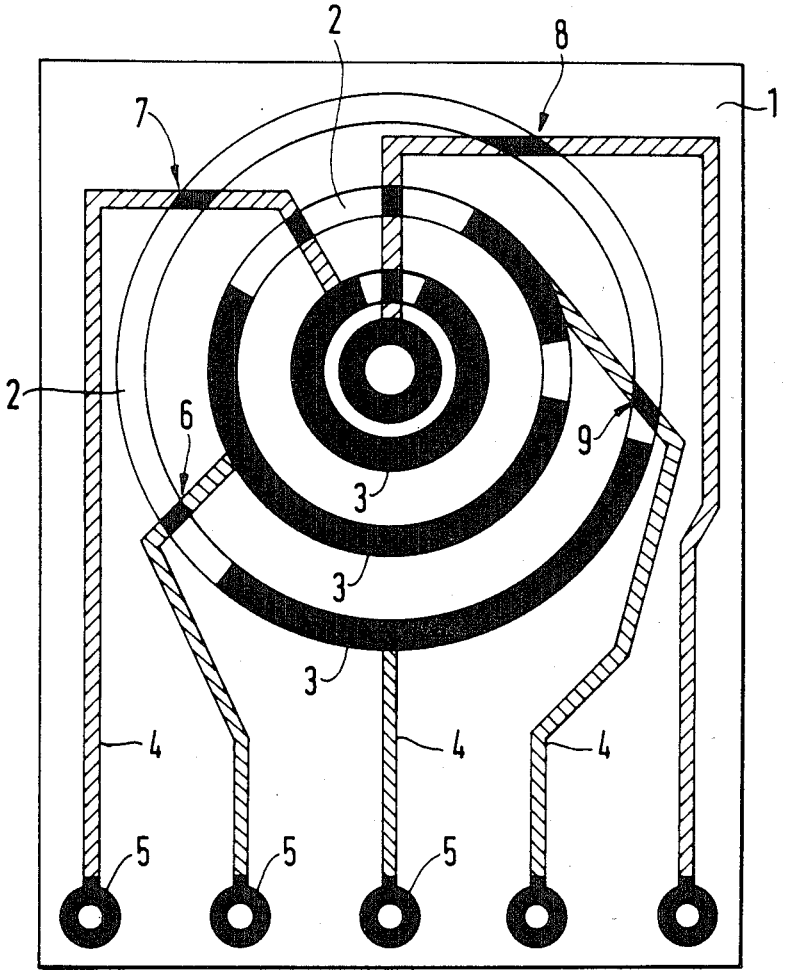
Fig. 1 PRIOR ART
FIG. 1 shows a printed circuit board for an electric code switch according to the state of the art.

On the printed circuit board 1 of insulating material, a conductor pattern is produced by way of etching. The conductors are indicated partly in black and partly by hatch lines. The black-indicated conductors 3 form the fixed contacts and those parts of the conductors which are provided with a layer of noble metal. The hatch-line-indicated conductors 4 form the lead-in conductors for the fixed contacts 3 and were covered up prior to the gold-plating. Apart from the fixed contacts 3 also the angular connecting contacts 5 are provided with a layer of gold which are attached to electric lead-in conductors.

The contact paths for the movable contacts 5A schematically shown in FIG. 2A are indicated by the five circular contact paths 2 which are arranged concentrically in relation to one another.

The portions of the contact paths which are not indicated in black, are actually invisible on the circuit board. As a rule, however, they are recognizable on the printed circuit board insofar as the angular zones between the contact paths are printed with the covering lacquer for the gold plating. With the covering lacquer there is also printed the circuit board 1 outside the contact path 2, with the exception of the connecting contacts or contact rings 5. Therefore, all conductors on the contact paths are provided with a layer of gold, hence not only the contact rings 5, but also those portions of the lead-in conductors 4 which intersect a contact path. This is the case at the points indicated by the reference numerals 6, 7, 8, and 9, where the lead-in conductors 4 are compulsorily coated with a layer of gold.

FIG. 2 shows the same printed circuit board for a code switch as in FIG. 1, but here the conductors are disposed in accordance with the invention, which leads to a considerable saving of gold. As can be seen from this type of embodiment as shown in FIG. 2, only individual contacts are provided for on each contact path, while the electric connection of a series of the individual contacts as connected to one another, extends between the contact paths. Outside the contact paths 2 there are disposed the connecting lines between the individual contacts, which are indicated by the reference numerals 10, 11, 12, 13, and 14. Since these connecting lines can be covered with a lacquer prior to the gold plating, between the contact paths and outside the contact paths, this results in a considerable saving of gold, because the surface to be gold-plated are considerably smaller as will easily result from a comparison with the black-indicated surface portions of FIG. 1. The reduction of gold-plated areas forming fixed contacts 3 is made by replacing conventional solid strips thereof with a series of separate fixed contacts 3 interconnected by conductors 10–14 outside the circular contact paths 2. The connecting lines 10–14 are parallel and close to the circular contact paths 2.

The connecting lines 10, 11, 12, 13 and 14 are disposed almost in parallel with the contact paths 2 and at a distance therefrom, and are connected to the fixed contacts 3 by means of connecting webs 15 extending almost vertically in relation to the contact paths 2.

At the same time, the lead-in conductors are disposed at those points where the lead-in conductors extending to the fixed contacts, intersect the sliding path, in such a way as to intersect the contact paths vertically radially thereto. Therefore, instead of the diagonal or tangentional intersections 7, 8 and 9 in FIG. 1, it is now possible for the lines to intersect radially at the same points as shown in FIG. 2. Thus, it is possible to still further reduce the surface area to be gold-plated by changing the location pattern of the lead-in conductors.

What is claimed is:

1. A printed circuit board for an electric switch and comprising:

conductors printed on said board and being coated with a layer of a noble material so as to form fixed contacts coacting with associated switch moving contacts;

said fixed contacts being intermittently disposed along predetermined contact paths on said circuit board;

said fixed contacts being linked and intersected by connecting conductors spaced apart from and linearly following substantial positions of said contact paths.

2. The board as claimed in claim 1, wherein said connecting conductors include link webs radially interesecting said contact paths and forming fixed contacts at intersections with the paths.

3. The board as claimed in claim 2, wherein said fixed contacts and said connecting conductors are located along substantially concentrical paths.

4. The board as claimed in claim 1, wherein said connecting conductors are covered by a layer of said noble metal at intersections with said contact paths.

5. A printed circuit board for an electric switch and comprising:

conductors printed on said board and being coated with a layer of noble material as to form fixed contacts coacting with associated switch moving contacts;

said fixed contacts being intermittently disposed along predetermined contact paths on said circuit board;

said fixed contacts linked by connecting conductors spaced apart from said contact paths;

the fixed contacts connected to said corresponding connecting conductors by link webs radially extending and intersecting said contact paths, and forming fixed contacts at intersections with said paths;

said fixed contacts and said connecting conductors located along substantially concentrical paths;

said connecting conductors covered by a layer of said noble metal at intersections with said contact paths.

* * * * *